United States Patent [19]

Thene

[11] 4,326,673

[45] Apr. 27, 1982

[54] AGGREGATE DISTRIBUTOR

[76] Inventor: Anthony A. Thene, 517 Wilson Ave. SE., St. Cloud, Minn. 56301

[21] Appl. No.: 56,048

[22] Filed: Jul. 9, 1979

[51] Int. Cl.[3] ..... E01C 19/20

[52] U.S. Cl. ..... 239/657; 198/665; 198/677; 239/665; 239/675

[58] Field of Search ..... 239/657, 664, 671, 675, 239/682, 683, 687; 198/664, 665, 677

[56] References Cited

U.S. PATENT DOCUMENTS

| | | | |
|---|---|---|---|
| 319,299 | 6/1885 | Morgan | 198/665 |
| 368,182 | 8/1887 | Birkholz | 198/665 |
| 2,947,544 | 8/1960 | Hurt | 239/664 X |
| 3,510,066 | 5/1970 | Swenson | 239/675 X |

*Primary Examiner*—Andres Kashnikow

*Attorney, Agent, or Firm*—H. Dale Palmatier

[57] ABSTRACT

An aggregate distributor on the rear of a truck dump box including an elongate housing extending transversely across the end of the truck and having a multiplicity of discharge ports through which the aggregate is dropped onto spinners swingably suspended from the distributor housing, a square tubular rotary shaft in the housing carrying conveying, mixing and agitating vanes which are rotationally adjustable on the shaft to cause aggregate to be propelled along the shaft in various directions, in accordance with the discharge ports that are open.

5 Claims, 5 Drawing Figures

AGGREGATE DISTRIBUTOR

This invention relates to an aggregate agitator and spreader for distributing sand and gravel over the surface of a roadway.

BACKGROUND OF THE INVENTION

In northern climates, it is common practice to sprinkle quantities of sand or other aggregates including certain chemicals onto roadway surfaces after winter time storms to render the ice on the road surface less slippery and to melt the ice for removal.

It has been conventional to mount a distributing device on the tailgate end of the box of a dump truck so that the sand or aggregate may be distributed over an area of the road surface behind the truck.

However, many of the modern streets and highways are four lanes wide with two lanes going in each direction, and in addition, there is often an additional left turn lane near the center of the roadway, and an additional right turn lane adjacent the right or outside edge of the roadway. It has been found that the distributing equipment previously available for use on the tailgate end of a box on a dump truck is inadequate for obtaining the proper spreading of sand and gravel across the entire width of the usable roadway surfaces.

SUMMARY OF THE INVENTION

An object of the invention is to provide a new and improved sand and aggregate distributing apparatus for attachment to the rear end of a dump truck box to facilitate spreading the aggregate over road surfaces of various widths by spinners suspended from the bottom of a transverse supply hopper wherein the aggregate is moved along the hopper into the spinners from the entire width of the truck.

A feature of the present invention is the provision of a distributing housing to receive the sand or aggregate from the box of the dump truck and to deliver the sand or aggregate onto a plurality of spinners suspended from the bottom of the distributing housing; the housing having a plurality of gated openings through which aggregate is allowed to fall onto the spinners and as to allow the spinners to be moved to various locations, depending upon the nature of the roadway surfaces to be spread with aggregate; and the distributing housing having an agitator with a revolving shaft having a multiplicity of aggregate agitating paddles revolving thereon, the paddles being oriented at an angle to the shaft axis so as to cause the aggregate to move along the shaft through the distributing housing; and the paddles being adapted to be turned to various angles so that the sand or aggregate is supplied to the spinners at the proper rate and as to permit opening of various gates in the housing to facilitate relocating of the spinners for various spreading purposes.

An advantage of the present invention is to permit the distributor to throw the sand and aggregate into both driving lanes and into the adjacent left turn and right turn lanes; and to permit the spinners to distribute gravel for seal coating the roadway surface.

DETAILED SPECIFICATION

Figure 1:
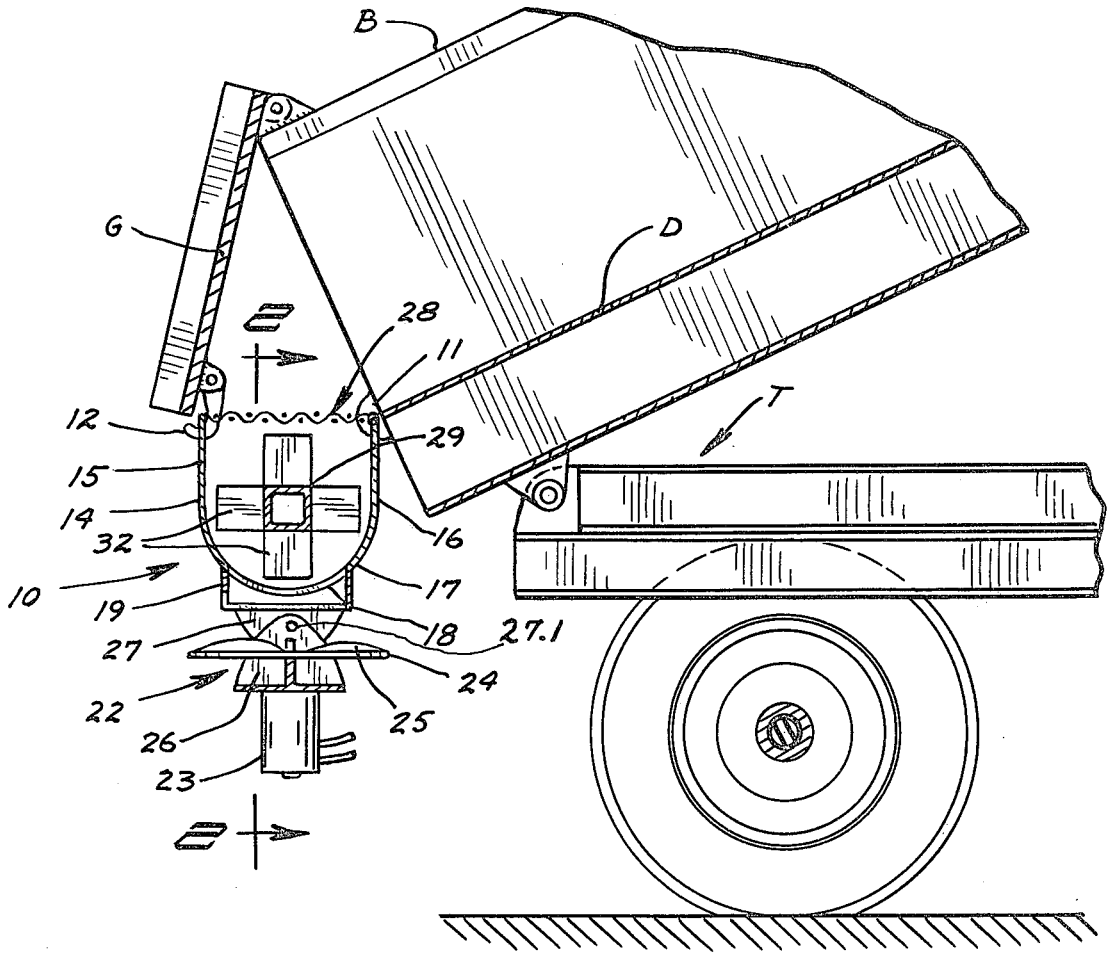
FIG. 1 is a section view through the rear portion of a dump truck with the box partly raised and illustrating the distributing apparatus in section.
Figure 3:
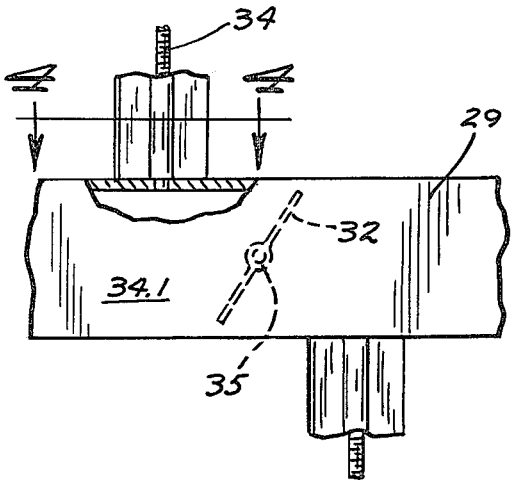
FIG. 3 is an enlarged detail elevation view showing the arrangement of the distributor paddles or vanes on the rotatable shaft.
Figure 4:
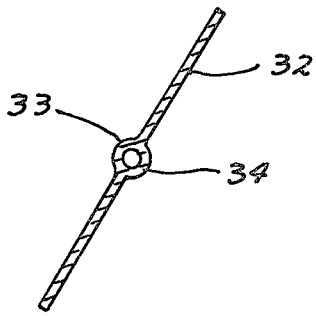
FIG. 4 is an enlarged detail section view taken at 4—4 in FIG. 3.

One form of the invention is shown in the drawings and is described herein.

The aggregate distributor, indicated in general by numeral 10, is shown attached to the dump box B of a dump truck T adjacent the rear edge of the deck D in the dump box. The tailgate G of the tump box is utilized for assisting in supporting the housing 10 which is supported from brackets 11 and 12 respectively, which are affixed to the box and tailgate.

The aggregate distributor includes an elongate open-topped housing 14 which extends across the entire width of the dump box B and has outboard ends 14.1 and 14.2 which extend significantly beyond the sides of the dump box B.

The housing 14 has upright front and rear walls 15 and 16 and has a smoothly curved bottom wall 17 with a multiplicity of aggregate discharge ports 18.1, 18.2, 18.3 and 18.4 therein.

At each of the discharge ports, a rectangular mounting collar 19 is welded to the bottom wall 17 of the housing to carry a removable slide gate 20 on in-turned flanges 21 so as to facilitate selectively opening certain of the discharge ports.

Figure 2:
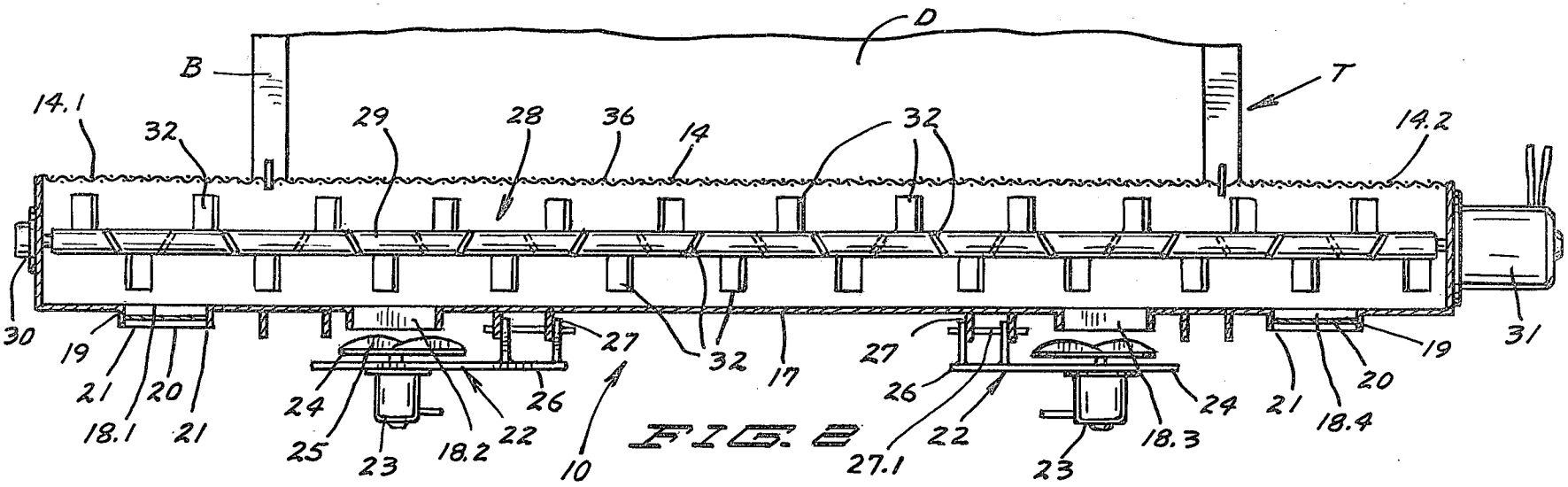
FIG. 2 is a longitudinal section view of the distributing apparatus taken approximately at 2—2 in FIG. 1.

A pair of spreading spinners are located beneath a pair of the open discharge ports, and in FIG. 2, the ports 18.2 and 18.3 are open. The spinners 22 each include a hydraulic motor 23, a revolving plate 24 with a plurality of upright impellor ribs 25 on the plate. A mounting bracket 26 is swingably suspended on ears 27 welded to the bottom wall of the housing, adjacent the discharge openings 18.1–18.4. A suspending pivot rod 27.1 extends through aligned openings in the bracket and ears to allow the spinner 22 to remain in predetermined horizontal relation with respect to the ground, regardless of the angle of tilting of the dump box B.

It will be recognized that the slide gates 20 are entirely removable from the mounting collars 19 so that the adjacent discharge openings are completely unobstructed.

An aggregate conveying, mixing and agitating rotor 28 is disposed in the housing 14 and includes an elongate shaft 29 which is tubular and square in cross section. The shaft 29 has one end mounted in a bearing 30 at the end of the housing, and the other end of the shaft is connected to the drive output of a hydraulic motor 31 for revolving the shaft.

The rotor 28 also includes a multiplicity of flat vanes 32 on the shaft, and adjustable to various angular orientations with respect to the rotation axis of the shaft.

Figure 5:
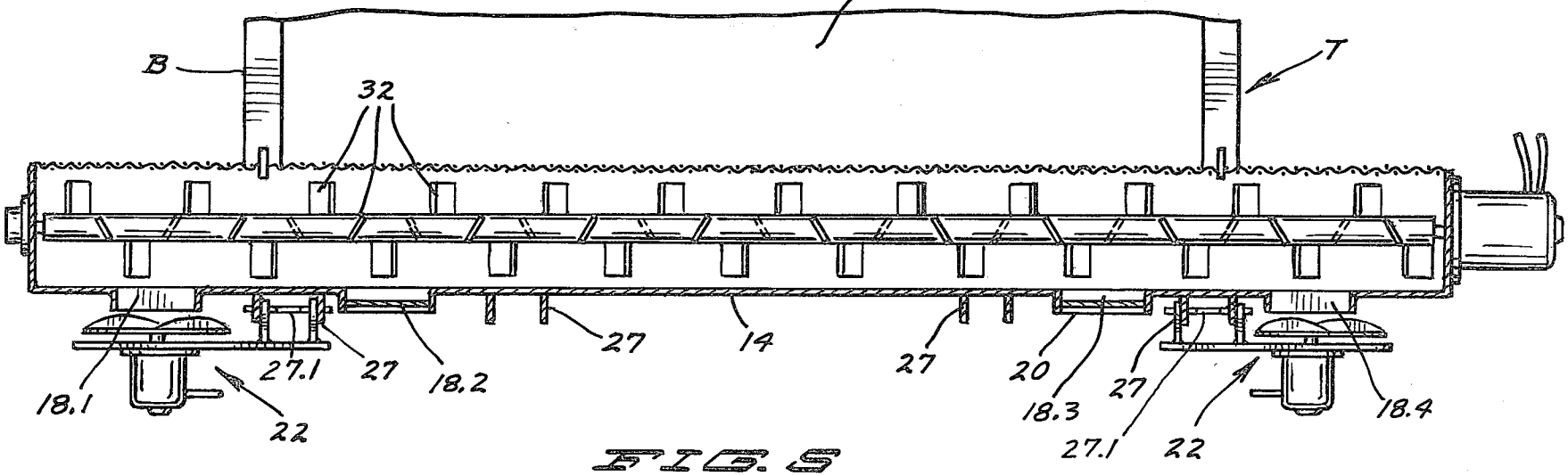
FIG. 5 is a detail section view similar to FIG. 2 and showing alternate positions of the spinners with alternate gate openings in the distributing housing.

As illustrated, each of the vanes 32 has a central mounting sleeve 33 through which a threaded stud 34 extends. The threaded stud 34 is affixed as by welding at its inner end 34.1 to the sidewall of the square shaft 29, and accordingly is immovable thereon. A nut 35 on the end of the threaded shaft 34 clamps the vane 32 tightly against the side face of the square shaft so as to render the vane substantially immovable with respect to the shaft. The angular orientation of the vane contributes materially to the function of moving the aggregate longitudinally along the shaft when the rotor 28 is revolved. The capacity of the vanes 32 to be angularly adjusted, makes it possible to supply all of the aggregate in the housing to the discharge openings which happen to be open under one set of circumstance. It will be recognized that, in FIG. 2, the discharge openings 18.2 and 18.3, intermediate the length of the housing 14, are open. However, in another arrangement, as illustrated in FIG. 5, the ports 18.1 and 18.4 are open, while the ports 18.3 and 18.2 are closed. In this arrangement, the vanes move the aggregate outwardly to the outboard ends of the housing so as to supply the proper quantity of aggregate to the open discharge ports so that the aggregate can drop through and be broadcast by the spreading spinner.

It will be seen that additional mounting ears 27 are provided adjacent each of the openings so that the spreading spinners 22 can be relocated to confront the open discharge port.

It will be seen in FIG. 5 that numerous of the vanes 32 are reoriented as compared to FIG. 2 so as to cause the aggregate to be conveyed entirely to the outboard ends of the housing 14 to supply the aggregate to the ports 18.1 and 18.4.

In FIG. 2, a protective screen or large size mesh 36 is seen to overlie the top edge of the housing 14 to prevent workmen from getting their hands down into the housing and to prevent large rocks that may be in the aggregate from bending the vanes of the rotor.

In operation, the aggregate distributor 10 is set up as illustrated in FIG. 2 for spreading aggregate directly behind the dump box of the truck, as in spreading gravel for seal coating asphalt roadways, and as in sprinkling sand and chemicals onto icy surfaces of narrow roads in the winter time. In this situation, the dump box B of the truck T is tilted to approximately the position of FIG. 1, and aggregate within the box will flow by gravity into the top of housing 14. The revolving rotor 28 causes the vanes 32 to mix the aggregate in the housing very thoroughly, while the vanes are simultaneously breaking up any chunks that may exist in the aggregate and simultaneously moving the aggregate along the length of the housing toward the open discharge ports 18.1 and 18.4. It will be recognized that the vanes are oriented, at either side of the center of the housing so as to move the aggregate respectively toward the ports 18.1 and 18.4. At the extreme outboard ends of the rotor, the vanes 32 are oppositely oriented so as to pull any aggregate that may exist at the extreme outer ends of the housing toward the open discharge ports.

As the box B is tilted to various angles, the spinners 22 remain at a predetermined orientation with respect to the ground so that the spinner plates 24 remain substantially horizontal and the aggregate will be evenly broadcast across the roadway surface.

In other situations and especially during winter sanding of roadway surfaces to make icy conditions less slippery, the gates 20 are removed out of obstructing relation with discharge ports 18.4 and 18.1 and are slipped into the other mounting collars 19 so as to obstruct the discharge ports 18.2 and 18.3, substantially as illustrated in FIG. 5.

The spinners 22 are removed from the mountings seen in FIG. 2 and are relocated as seen in FIG. 5 as to confront the discharge ports 18.1 and 18.4. This arrangement of the spinners 22 at the outboard ends of the housing causes the sand to be rather evenly broadcast in multiple directions from the distributor 10 for the purpose of sanding both lanes of a two lane road and simultaneously broadcasting sand into the left turn lane located adjacent the center of the roadway and simultaneously into the right turn lane at the extreme right of the surfaced roadway. It will be recognized in FIG. 5 that certain of the vanes 32 have been reoriented, by loosening and then turning the vanes relative to the shaft. It is obvious that in FIG. 5, all of the aggregate is conveyed to the outboard ends of the distributor housing 14 so as to supply the necessary aggregate to the spinners at the extreme outer ends and adjacent the openings 18.1 and 18.4.

It will be seen that this invention provides a truck dump box-mounted aggregate distributor supplying aggregate for spinners, which spinners are variously located beneath any of a pair of a plurality of open discharge ports for the purpose of broadcasting aggregate from the truck dump box onto the roadway surface.

What is claimed is:

1. A truck dump box-mounted distributor supplying loose aggregate to spreading spinners, comprising an elongate open-topped housing for attachment across the end of such a dump box to extend transversely of the direction of travel of the truck for receiving such aggregate in both chunks and loose particles, the housing having elongate bottom and upright sidewalls in stationary relation to each other to receive and confine such aggregate, the bottom wall with a multiplicity of discharge ports therein through which the aggregate may be dropped onto such a spreading spinner, the housing having gate means at said discharge ports for selectively opening and closing the ports and thereby changing the location at which spreading of the aggregate occurs, an elongate aggregate conveying, mixing and agitating rotor in the housing and extending along the discharge ports and substantially to the ends of the housing, the rotor including a shaft rotatably mounted on the housing, and means revolving the shaft, and a multiplicity of aggregate propelling and chunk breaking vanes protruding outwardly from the shaft and being oriented obliquely of the shaft axis to propel aggregate along the housing and toward open discharge ports, and the vanes having means variably securing the vanes to the shaft at any of a multiplicity of pitches and at either direction of slope facilitating changing the speed and direction of aggregate movement along portions of the housing as different combinations of discharge ports are opened and also changing the thoroughness of breaking aggregate chunks into loose particles, and aggregate spreading means demountably suspended on the housing beneath one of the discharge ports and movable to a location beneath another of the ports.

2. The aggregate distributor according to claim 1 and the shaft being substantially square in cross section, and the vanes each having an edge bearing firmly and flush against only one of the flat sides of the shaft to be retained thereby at a desired angle.

3. The aggregate distributor according to claim 2 and means clamping one edge of each of the vanes against the adjacent flat side of the shaft for retaining the vane at a particular pitch and direction of slope with respect to the shaft axis which respectively regulate speed and direction of aggregate movement.

4. The aggregate distributor according to claim 1 and said multiplicity of discharge ports including a pair of ports adjacent the ends of the housing and also including at least one additional port intermediate the ends.

5. The aggregate distributor according to claim 1 and said spreading means including a spreading spinner disposed beneath an open discharge port of the housing to spread and broadcast the aggregate therefrom and having a demountable mounting means facilitating relocating the spinner at any of the discharge ports, the spinner being swingably suspended from the housing to maintain a predetermined orientation with respect to the roadway surface and regardless of the angle to which the dump box may be tilted.

* * * * *